United States Patent [19]

Maki et al.

[11] Patent Number: 4,761,344

[45] Date of Patent: Aug. 2, 1988

[54] VEHICLE COMPONENT PART

[75] Inventors: Yoshihiro Maki, Miura; Makoto Kano, Yokohama; Akira Fujiki, Yokosuka; Ichiro Tanimoto, Yokohama, all of Japan

[73] Assignee: Nissan Motor Co., Ltd., Yokohama, Japan

[21] Appl. No.: 36,485

[22] Filed: Apr. 9, 1987

[30] Foreign Application Priority Data

Apr. 14, 1986 [JP] Japan ..... 61-86252

[51] Int. Cl.[4] ..... B22F 3/00

[52] U.S. Cl. ..... 428/552; 75/244; 123/90.39; 419/12; 428/564; 428/627; 428/908.8

[58] Field of Search ..... 75/244; 419/12; 428/552, 564, 627, 908.8; 123/90.39

[56] References Cited

U.S. PATENT DOCUMENTS

| | | | |
|---|---|---|---|
| 3,980,444 | 9/1976 | Reen | 75/244 |
| 4,140,170 | 2/1979 | Baum | 419/12 |
| 4,340,432 | 7/1982 | Hede | 75/246 |
| 4,556,533 | 12/1985 | Oaku et al. | 419/11 |

FOREIGN PATENT DOCUMENTS

| | | |
|---|---|---|
| 56-8904 | 2/1981 | Japan . |
| 56-15773 | 4/1981 | Japan . |
| 58-67842 | 4/1983 | Japan . |

*Primary Examiner*—Stephen J. Lechert, Jr.

*Attorney, Agent, or Firm*—Foley & Lardner, Schwartz, Jeffery, Schwaab, Mack, Blumenthal & Evans

[57] ABSTRACT

A rocker arm of a valve mechanism of an automotive internal combustion engine is composed of a rocker arm tip secured to a rocker arm main body. The rocker arm tip includes a sheet type sintered alloy adhered to a steel substrate. The sintered alloy includes a joining phase of martensite stainless steel, and a hard phase of boride and/or multiple boride of at least one, including iron, of elements capable of forming boride and/or multiple boride. The hard phase is homogeneously dispersed in the joining phase. The sintered alloy contains boron ranging from 3.0 to 5.0% by weight, and the hard phase ranging from 40 to 62% by weight. Additionally, the sintered alloy has a maximum grain size of the boride and/or multiple boride ranging not larger than 50 μm, a Rockwell A-scale hardness number ranging not less than 80, and a deflective strength ranging not lower than 175 kgf/mm$^2$.

22 Claims, 2 Drawing Sheets

1a
h
H
1
2

ROCKER ARM TIP
CAM NOSE TOP
PITTING SLIGHTLY OCCURRED IN TIP
MAXIMUM ABRATION DEPTH ( μm )
OF ROCKER ARM TIP, CAM NOSE TOP
0
50
100
150
20 21 22 23 24 25 26 27 28 29 30 31 32 33 34 35 36 37 38 39
SAMPLE NO.

VEHICLE COMPONENT PART

BACKGROUND OF THE INVENTION

1. Field of the Invention

The present invention relates to a component part of an automotive vehicle component part which is in sliding contact with another part in vehicle operation, and more particularly to a rocker arm of a valve operating mechanism of the automotive internal combustion engine which rocker arm is in sliding contact with a camshaft with a high bearing pressure.

2. Description of the Prior Art

Recently in the field of automotive internal combustion engines, performance improvement and freedom from maintenance have been rapidly and increasingly developed requiring more severe or improved slide-move characteristics or performance for component parts in sliding contact with other parts, for example, a rocker arm in sliding contact with a camshaft. In this regard, it has been proposed and put into practical use that the rocker arm is constructed of a rocker arm main body and a rocker arm tip in contact with the camshaft, in which the rocker arm tip is made of a variety of materials such as chilled casting, ferrous sintered alloy of the type wherein carbide is dispersed therein, super hard alloy, ceramic, and the like.

Of these materials, the chilled casting and the carbide dispersed type ferrous sintered alloy are presently insufficient in wear resistance. The super hard alloy is high in attacking ability against an opposite member (such as the camshaft). The ceramic is high in cost and liable to break down or fall off. Thus, such conventional materials are all insufficient in slide-move characteristics or performance required for the parts in sliding contact such as the rocker arm. Accordingly, it has been eagerly required to develop a rocker arm having a rocker arm tip which is lower in cost than the super hard alloy and the ceramic and exhibiting excellent wear resistance and low attacking ability againt the opposite member.

SUMMARY OF THE INVENTION

A vehicle component part according to the present invention is composed of a section having a surface in sliding contact with an opposite member. The section is formed of a sintered alloy including a joining phase of martensite stainless steel, and a hard phase of boride and/or multiple boride of at least one, including iron, of elements capable of forming boride and/or multiple boride. The hard phase is homogeneously dispersed in the joining phase. The sintered alloy contains boron ranging from 3.0 to 5.0% by weight, and the hard phase ranging from 40 to 62% by weight. Additionally, the sintered alloy has a maximum grain size of the boride and/or multiple boride ranging not larger than 50 μm, a Rockwell A-scale hardness number ranging not less than 80, and a deflective strength ranging not lower than 175 kgf/mm$^2$. By virtue of excellent wear resistance and concordance with the opposite member due to boride and/or multiple boride, excellent corrosion resistance due to martensite stainless steel, and strong adhesion between the joining phase of the martensite stainless steel and the hard phase of boride and/or multiple boride, abrasion amount of the component part and the opposite member can be remarkably reduced while overcoming insufficiency in wear resistance of the component part in the conventional chilled casting or carbide dispersed type ferrous sintered alloy, overcoming high attacking ability against the opposite member in the conventional supper hard alloy, and overcoming low impact strength in ceramic. Thus, the present invention can provide the engine component part lower in cost and more excellent in wear resistance than the super hard alloy and the ceramic, and low in attacking ability against the opposite member.

DETAILED DESCRIPTION OF THE INVENTION

Figure 1:
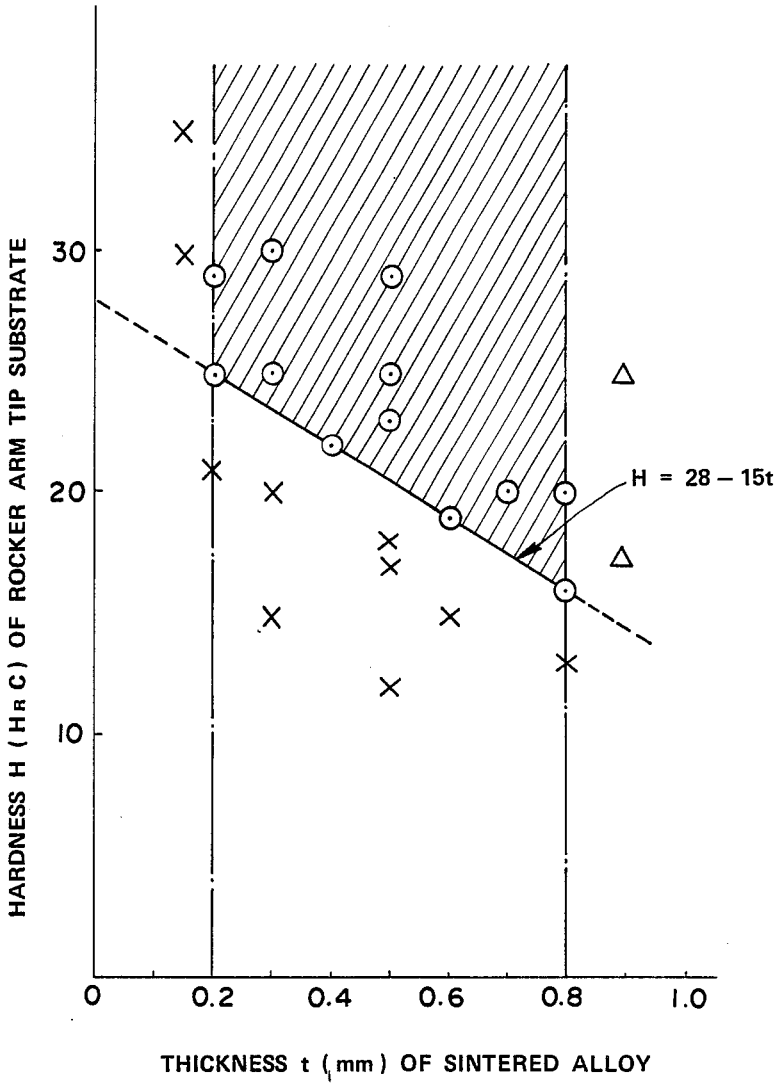
FIG. 1 is a graph showing the state of deformation and buckling of a rocker arm produced in a durability test, in terms of the hardness of a rocker arm tip substrate and the thickness of a sheet type sintered alloy containing boride and/or multiple boride.

According to the present invention, a component part of a vehicle comprises a section having a surface in sliding contact with a member. The section of the component part is formed of a sintered alloy including a joining phase of martensite stainless steel, and a hard phase of boride and/or multiple boride of at least one, including Fe (iron), of a variety of elements capable of forming boride. The elements are, for example, Fe, Mo (molybdenum), W (tungsten), Cr (chromium), Ti (titanium), V (vanadium), Nb (niobium), Ta (tantalum), Hf (hafnium), Zr (zirconium), Co (cobalt), and the like. The hard phase is homogeneously dispersed in the joining phase. The sintered alloy contains boron ranging from 3.0 to 5.0% by weight and the hard phase ranging from 40 to 62% by weight. The sintered alloy has a maximum grain size not larger than 50 μm and a Rockwell A-scale hardness number not smaller than 80, and a deflective strength not less than 175 kgf/mm$^2$.

Discussion of the principle of the present invention will be made hereinafter on a rocker arm of a valve operating mechanism of an automotive internal combustion engine as the above-mentioned component part, in which the rocker arm is arranged in accordance with the present invention, the rocker arm having a rocker arm tip in sliding contact with the cam section of a camshaft.

Now in recent years a so-called exhaust gas recirculation (EGR) system has been provided to most gasoline-powered engines, and planned and investigated for use in diesel engines in order to reduce NOx as a harmful component of exhaust gas, in which any measure is required against problem that abrasion of the rocker arm tip and the camshaft increases under the influence of exhaust gas recirculation.

As a result of various investigations made by the inventors on influences of the exhaust gas recirculation to abrasion of the rocker arm tip and the camshaft cam section, the inventors have found a new knowledge that the increased abrasion of the rocker arm tip and the camshaft cam section is caused by the synergistic effect of the removal of a wear resistance protective film due to soot mixed into engine lubricating oil and corrosion of the newly exposed surface of metal sections in sliding contact due to SOx gas in exhaust gas.

The present invention has been envisaged and accomplished for the first time as a result of the inventors' attention to the above-mentioned new knowledge. More specifically, in order to prevent peeling of the wear resistance protective film, boride and/or multiple boride excellent in concordance with metal as compared with conventional carbides is used as the hard phase of the sintered alloy, thereby reducing abrasion by metal-to-metal contact. Additionally, in order to prevent corrosion of the newly exposed surface of metal sections in sliding contact, the matrix structure of the sintered alloy is formed of martensite stainless steel which is excellent in wear resistance, thereby reducing corrosion wear of the sintered alloy. Thus, even in the case where an EGR system is provided to the engine, abrasion amount of not only the rocker arm tip but also of the camshaft cam section as the opposite member can be suppressed to a very low level. Such advantageous effect can be obtained for the first time in accordance with the present invention while it cannot be attained by conventional materials of the rocker arm tip.

The present invention will be discussed further in detail hereinafter with reference to the rocker arm of the automotive engine valve operating mechanism.

A rocker arm according to the present invention is provided with a section which slidingly contacts a cam section of the camshaft. The section in sliding contact is made of a sintered alloy which is characterized by having a structure in which hard phases of at least one (including iron) of elements capable of forming boride and/or multiple boride are homogenously dispersed in a joining phase of martensite stainless steel.

Thus, the hard phase is formed of boride and/or multiple boride of at least one (including Fe) of the boride forming elements such as Fe, Mo, Cr, W, Ti, V, Nb, Ta, Hf, Zr, Co and the like. In this connection, there are various types of borides such as MB or $M_2B$ (M represents a metal) and varius types of multiple borides such as $M_xNY_{Bz}$ (M and N represent respectively metals). Of these types of boride and multiple boride, multiple borides of types of $Mo_2FeB_2$, WFeB, and $W_2FeB_2$ are preferable to stably increase the deflective strength and the hardness of the sintered alloy particularly in the case where they exist as a major part in the hard phase. With respect to the multiple boride of the type of $Mo_2FeB_2$, WFeB, or $W_2FeB_2$, it may be of a type wherein Mo and W are substituted by each other, or Fe is partially substituted by Cr, Ni, and Co thereby providing similar excellent characteristics in deflective strength and hardness.

Subsequently, reasons for selecting Fe, Mo, W, Cr, Ti, V, Nb, Ta, Hf, Zr, Co and the like as the boride forming elements will be discussed hereinafter.

Fe:

Boride and/or multiple boride containing Fe (iron) exhibits a sufficiently high hardness and toughness. The joining phase of stainless steel formed upon adding a suitable amount of Cr and Ni exhibits excellent corrosion resistance. Additionally, boride and/or multiple boride are industrially readily available and relatively low in cost. Accordingly, the sintered alloy used as the in sliding contact section of the rocker arm preferably contains Fe as much as possible within an allowable range from view points of wear resistance and corrosion resistance.

Mo, W:

Mo (molybdenum) and W (tungsten) are elements belonging to the group VIb of the periodic table and form high hardness boride and/or multiple boride. Particularly, they are effective to form the above-mentioned multiple boride of the types of $Mo_2FeB_2$, WFeB, $W_2FeB_2$. Additionally, Mo and W have the prominent effect of improving the deflective strength, wear resistance and corrosion resistance of the joining phase of the sintered alloy.

Cr:

Cr (chromium) is also an element for forming stable boride and/or multiple boride. Particularly in case where Cr is added for the hard phase, wear resistance of the hard phase can be remarkably improved. Additionally, Cr is very effective to improve wear resistance by forming the joining phase of stainless steel upon Cr combining with Fe.

Ti, V:

Ti (titanium) belongs to the group IVb of the periodic table, and V (vanadium) belongs to the group Vb of the same. They both form stable and high hardness boride and/or multiple boride. Additionally, Mo and W of the above-mentioned multiple boride of the types of $Mo_2FeB_2$, WFeB, $W_2FeB_2$ are substituted with Ti and V, in which a part of Ti and V are formed into alloy in the joining phase thereby not only increasing the hardness of the sintered alloy but also preventing coarsening of crystal grain of the sintered alloy during liquid phase sintering. Zr (zirconium) and Hf (hafnium) and belonging to the periodic table group IVb, the same as Ti, and Nb (niobium) and Ta (tantalum) belonging to the periodic table group Vb, the same as V seem to exhibit the same effect as Ti and V.

Co:

Co (cobalt) is an element to form stable boride and/or multiple boride and had the effect of improving the wear resistance of the sintered alloy upon being added to the hard phase. As mentioned above, Co exhibits a noticeable effect in the form wherein a part of Fe in multiple boride of the types of $Mo_2FeB_2$, WFeB and $W_2FeB_2$ is substituted by Co.

With respect to the added amount or content of B (boron) which combines with the above-mentioned boride forming elements to form boride and/or multiple boride, if it is less than 3.0% by weight, the rate of the hard phase is too small thereby causing shortage in wear resistance. If it exceeds 5.0% by weight, the rate of the joining phase is too small thereby lowering deflective strength and impact value. Thus, the added amount or content of B is preferably within a range from 3.0 to 5.0% by weight. Additionally, the rate of the hard phase becomes 40% by weight when the added amount of B is 3.0% by weight; while the rate of the same becomes 62% by weight when the added amount of B is 5.0% by weight. Thus, the rate of the hard phase in the sintered alloy is preferably within a range from 40 to 62% by weight.

With respect to grain size of the boride and/or multiple boride, if it exceeds 50 μm, the boride and or the multiple boride is liable to aggregate thereby causing non-uniform distribution of them so that scattering in hardness tends to increase in the sintered alloy. As a result, not only mechanical characteristics such as deflective strength and impact value but also wear resistance are lowered. Thus, the grain size of the boride and/or multiple boride is preferably not larger than 50 μm.

As mentioned above, the feature of the sintered alloy forming the slidingly contacting section of the rocker arm according to the present invention resides in the fact that the joining phase is formed of martensite stainless steel. The matrix of this martensite stainless steel joins with the boride and/or multiple boride as the hard phase with a high joining strength. The matrix of martensite stainless steel is not only excellent in wear resistance but also very inexpensive as compared with a cobalt-base or nickel-base joining phase. Additionally, it is to be noted that, of a variety of stainless steel joining phases, martensite stainless steel joining phase is particularly excellent in characteristics as a part of the structure of the sintered alloy. This is because adhesion of the joining phase increases thereby to increase the abrasion amount of the opposite member and of itself in case of austenite or ferrite stainless steel joining phase. In constrast, the joining phase of mertensite stainless steel is high in hardness and good in adhesion resistance. With respect to the content of Ni in the joining phase, if it is too large and accordingly the joining phase becomes of austenite, adhesion of the joining phase unavoidably increases. However, it is preferable to increase the content of Ni within a range where the joining phase becomes of martensite, which improves wear resistance of the joining phase.

It is preferable that the sintered alloy forming the section of the rocker arm in sliding contact has a Rockwell A-scale hardness number not smaller than 80. This is because local scuffing of the sintered alloy tends to occur if the Rockwell A-scale hardness number is smaller than 80, in which development of the local scuffing largely increases the abrasion amount of the rocker arm section in sliding contact and the opposite member. If the Rockwell A-scale hardness number exceeds 90, machining of the section surface in sliding contact is difficult in the scale of mass production. Thus, it is preferable that the Rockwell C-scale hardness number of the section in sliding contact is not larger than 90.

Further, it is preferable that the deflective strength of the sintered alloy forming the section of the rocker arm in sliding contact is not lower than 175 kgf/mm$^2$. This is because if the deflective strength is lower than 175 kgf/mm$^2$, pitting tends to occur and abrasion amount tends to increase. The tendency of pitting occurrence and abrasion amount increase due to the deflective strength lower than 175 kgf/mm$^2$ is noticeable particularly in the case where a high bearing pressure is applied to the surface of the section of the rocker arm in sliding contact.

As described above, the rocker arm according to the present invention is characterized by the fact that at least a section having a surface in sliding contact with the camshaft is formed of the sintered alloy containing the above-mentioned boride and/or multiple boride. Accordingly, the whole body of a rocker arm tip having the surface in sliding contact with the camshaft may be formed of the sintered alloy containing the above-mentioned boride and/or multiple boride; or otherwise only a surface portion in sliding contact with the camshaft may be a sheet made of the sintered alloy containing the above-mentioned boride and/or multiple boride, the surface portion being combined with a substrate or base material to form a rocker arm tip.

Subsequently, discussion will be made of the latter case in which the sheet type sintered alloy is combined with the substrate to form the rocker arm tip which is advantageous because of requiring small amounts of rare metals such as Mo and W and of being low in cost, in which the sheet type sintered alloy contains boride and/or multiple boride.

In this case, if the thickness of the sheet type sintered alloy is less than 0.2 mm, the sheet type sintered alloy tends to peel off the substrate at the interface therebetween, and additionally fine cracks tend to be produced in the sheet type sintered alloy in use. If the thickness of the sheet type sintered alloy exceeds 0.8 mm, improvement in effect can hardly recognized while increasing cost, and additionally the curvature of an already finished surface of the sheet type sintered alloy tends to be distorted during cooling after brazing owing to difference in thermal expansion between the sheet type sintered alloy and the substrate in case of the type where the rocker arm tip and a rocker arm main body are combined with each other by brazing. Thus, the thickness of the sheet type sintered alloy forming the section in sliding contact (or surface section) of the rocker arm tip is within a range from 0.2 to 0.8 mm.

The surface roughness of the sintered alloy containing boride and/or multiple boride in sliding contact with the camshaft is required to be smaller or finer than the conventional materials of rocker arm tip such as chilled casting and iron-chromium sintered alloy in order to prevent abrasion amount increase of the camshaft as the opposite member. The tendency of increasing camshaft abrasion amount is noticeable when engine speed increasing and decreasing operations are frequently carried out. The reason for this is not clear but supposed as follows: Boride and/or multiple boride containing iron is excellent in concordance with other metals but high in hardness as compared with the hard phase (usually, cementite or martensite) of the camshaft as the opposite member, so that the hard phase is scraped off if the surface roughness of the sintered alloy on the rocker arm side is large or rough. The inventors investigated the relationship between camshaft abrasion amount and the surface roughness of the sintered alloy containing boride and/or multiple boride. As a result, it was found that if the surface roughness ($R_{max}$ in Japanese Industrial Standard) of the sintered alloy on the rocker arm side was not larger or rougher than 2.0 $\mu$m, the abrasion amount of the rocker arm side and the camshaft side was very small. Thus, it was confirmed that the surface roughness of the sintered alloy of boride and/or multiple boride was preferably not larger or rougher than 2.0 $\mu$m ($R_{max}$).

In the case where the sheet type sintered alloy containing boride and/or multiple boride is combined with the substrate to form the rocker arm tip, the material of the substrate is required to have a certain degree of hardness as discused below, in which a required hardness of the substrate can readily and inexpensively obtained by heat treatment or the like if the substrate is made of steel having a C (carbon) content of 0.25% by weight. However, if the substrate is made of steel having a C content exceeding 0.5% by weight, C in the substrate is excessively diffused into the sintered alloy containing boride and/or multiple boride thereby allowing carbide to crystallize out in the joining phase of martensite stainless steel during liquid phase sintering carried out after the sintered alloy containing boride and/or multiple boride is combined with the substrate, thus lowering deflective strength and corrosion resistance of the sintered alloy containing boride and/or multiple boride. Thus, steel having a C content ranging from 0.25 to 0.5% by weight is preferably used as the material of the substrate.

The reason why the certain degree of hardness is required for the material of the substrate as above mentioned is as follows: If the material of the substrate is considerably soft, local buckling unavoidably occurs in the substrate in use thereby causing crack in the sheet type sintered alloy. Such buckling develops upon repeated stress being applied, so that the rocker arm tip deforms exceeding an allowable range thereby providing trouble on operation of engine valves such as intake or exhaust valves. The substrate material hardness required for preventing such buckling varies depending on bearing pressure applied onto the rocker arm tip and the thickness, hardness, deflective strengh and the like of the sheet type sintered alloy. In this regard, a variety of experiments by the inventors have revealed that such buckling of the substrate and fine crack of the sheet type sintered alloy does not occur if the hardness of the substrate and the thickness of the sheet type sintered alloy are in the relationship given by an equation of $H \geqq 28-15t$ wherein H is the hardness (Rockwell C-scale hardness number) of the substrate, and t is the thickness (mm) of the sheet type sintered alloy, under a bearing pressure (Hertz's contact pressure: normally not higher than 100 $kgf/mm^2$ while not higher than 150 $kgf/mm^2$ in maximum) which is considered to be presently and usually applied to rocker arm.

A typical method of securely and rigidly combining the rocker arm tip with the rocker arm main body is brazing carried out with brazing metal. In case of this brazing, it tends to occur that the hardness, raised by heat treatment or the like, of the rocker arm main body unavoidable lower below a certain desired value when the rocker arm main body is heated at a brazing temperature. In order to prevent this, it is preferable to use the following method in cases where the rocker arm tip is rigidly combined with the rocker arm main body: Regarding brazing metal, if copper brazing metal higher in brazing temperaure is used, crystal grain of the rocker arm main body and the rocker arm tip is unavoidably coarsened during brazing. Accordingly, it is preferable to use silver brazing metal which is lower in brazing temperature than the silver brazing metal. Regarding the material of the rocker arm tip substrate, mechanical structural low-alloy steel having a C (carbon) content of about 0.25 to 0.5% by weight as mentioned above. This is because if the C content exceeds 0.5% by weight, carbon in the substrate excessively migrates to the sheet type sintered alloy under the action of diffusion to allow carbide to crystallize out in the joining phase thereby lowering the deflective strength and the corrosion resistance of the sheet type sintered alloy, when the sheet type sintered alloy is sintered in liquid phase while making metallurgical joining to form the rocker arm tip upon heating at a temperature lower than the melting point of the substrate after the sheet type sintered alloy and the substrate are combined or assembled with each other. If the C content of the material of the rocker arm tip is less than 0.25% by weight, the substrate cannot obtain the necessary hardness in the below-described cooling rate after brazing. Thus, the C content of the material of the rocker arm tip substrate is preferable within a range from 0.25 to 0.5% by weight.

Subsequently, it is preferable to perform a normalizing treatment onto the rocker arm tip prepared by the above-mentioned method. Because the sintering temperature of the sheet type sintered alloy during liquid phase sintering is normally as high as 1200° C., crystal grain of the substrate is unavoidably coarsened. This will cause scattering of hardness of the substrate upon cooling after brazing. In order to prevent this, it is preferable that crystal grain of the substrate is made fine before brazing by carrying out the normalizing treatment.

Although heating by a heating furnace is usually used as a heating method during brazing, high frequency induction heating is preferable since it can easily accomplish cooling after brazing. Additionally, silver brazing metal is preferable as brazing metal. The brazing temperature at which brazing is carried out is preferably within a range from 820° to 880° C. This is because the brazing temperature of this range is coincident with an optimum hardening temperature of structural steel (H steel in Japanese Industrial Standard) which assures preferable hardenability for the material of the substrate of the rocker arm tip, and additionally a desired hardness of the substrate can be suitably obtained at the below-described cooling rate. With respect to the cooling rate after brazing, if it is lower than 40° C./min., a desired hardness of the substrate cannot be stably obtained. If it exceeds 120° C./min., it is too high and therefore the curvature of an already finished surface is distorted owing to the difference in thermal expansion between the sheet type sintered alloy and the substrate. Thus, cooling rate after brazing is preferably within a range from 40° to 120° C./min.

EXAMPLES

In order to evaluate the automotive engine component part (rocker arm) according to the present invention, Examples (Sample Nos. 1 to 10) of the present invention will be discussed hereinafter in comparison with Comparative Examples (Sample Nos. 11 to 15) which are out of the scope of the present invention.

First a rocker arm of Sample No. 1 was produced as follows: 50% by weight of Mo powder, 5.1% by weight of C powder, 2% by weight of Ni powder, 4% by weight of Fe powder, 0.4% by weight of graphite powder and 5% by weight of paraffin were mixed with powder of 13%B-5%Cr-Fe as the balance. This mixture was pulverized by a ball mill and thereafter compacted under a pressure to obtain a compact having a density ratio of 48% and of the sheet shape.

Subsequently, this sheet type compact was set on a substrate of a rocker arm tip which was made of SCM 435 (in Japanese Industrial Standard) and had been already formed and finished into a predetermined shape. Thereafter, sintering of the compact and joining of the same to the substrate were simultaneously carried out by heating the thus set compact and substrate in vacuum of $10^{-3}$ Torr at 1250° C. for 30 min thereby to form a rocker arm tip (the sintered compact had a composition as shown as Sample No. 1 in Table 1).

Next, the rocker arm tip was normalized at 900° C. for 1 hour and machined to obtain predetermined dimensions thereof in which the surface roughness ($R_{max}$) of a surface (in sliding contact with a camshaft) of the rocker arm tip is within a range of 1.5 to 2.0 $\mu$m. The rocker arm tip was then set through a sheet of silver brazing metal (silver solder) on a rocker arm main body made of S40C (in Japanese Industrial Standard) and heated at 850° C. by high frequency induction heating to accomplish the brazing. Immediately after this, cooling was made at a cooling rate of 80° C./min by compulsory air-cooling due to air blowing. Then, the final machining for finishing was made setting as a standard the surface (in sliding contact with the camshaft) of the rocker arm tip thereby to obtain a rocker arm according to the present invention as indicated as Sample No. 1 in Table 2.

Rocker arms (Examples) of Sample Nos. 2 to 10 and rocker arms (Comparative Examples) of Sample Nos. 11 to 15 were produced as follows: Various raw material powders were prepared and mixed so as to obtain compositions after sintering as shown in Table 1 and then pulverized by a ball mill and dried. Thereafter, compacting was carried out under pressure to obtain sheet type compacts having density ratio ranging from 45 to 50%.

Subsequently, the sheet type compacts were set on rocker arm tip substrates made of SCM 435, SCr 445, SNCM 447, SNCM 431 (in Japanese Industrial Standard) and thereafter heated in vacuum of $10^{-3}$ Torr for 30 min at optimum sintering temperatures (i.e., 1210° to 1280° C. shown in Table 1) for respective raw material powder blended ratios, thus simultaneously accomplishing both sintering of the compact and joining of the compact with the substrate thereby to obtain respective rocker arm tips.

Next, each rocker arm tip was normalized at 900° C. for 1 hr and then subjected to machining to obtain predetermined dimensions and to obtain a surface roughness ($R_{max}$) not larger or rougher than 2.0 μm. The thus machined rocker arm tip is set through silver brazing metal on a rocker arm main body made of S40C (in Japanese Industrial Standard), and then subjected to brazing and cooling under brazing conditions as shown in Table 2. Thereafter, final machining for finishing was made setting as a standard the surface (in sliding contact with camshaft) of the rocker arm tip. Thus, the rocker arms of Examples of Sample Nos. 2 to 10 and the rocker arms of Comparative Examples of Sample Nos. 11 to 15 were produced.

Next, a wear resistance evaluation test was conducted on the rocker arms of Sample Nos. 1 to 15 as shown in Tables 1 and 2 under conditions shown in Table 3. The result of the wear resistance evaluation test is shown in Table 4.

TABLE 3

| Item | Condition |
|---|---|
| Engine | Diesel engine (displacement: about 2.0 liters) |
| ERG rate | 40% by volume (recirculated exhaust gas relative to intake air) |
| Engine speed | 600–630 rpm |
| Cam material | Cast iron (surface chilled) |
| Valve spring Force | 27 Kgf (in installed state of valve spring) |
| Fuel | Diesel Fuel according to EPA (S: 0.2 wt % contained) |
| Lubricating oil | Nisseki 10W-30/CC (by Nippon Oil Co., Ltd) |
| Oil temperature | Varied within a range of 75–85° C. depending on engine operation |
| Test time | 1000 hrs |

TABLE 4

| Division | Sample No. | Abrasion amount (μm) of Rocker arm | Abrasion amount (μm) of Camshaft | Total Abrasion amount (μm) of Rocker arm and Camshaft |
|---|---|---|---|---|
| Example | 1 | 28 | 63 | 91 |

TABLE 4-continued

| Division | Sample No. | Abrasion amount (μm) of Rocker arm | Abrasion amount (μm) of Camshaft | Total Abrasion amount (μm) of Rocker arm and Camshaft |
|---|---|---|---|---|
| | 2 | 30 | 59 | 89 |
| | 3 | 35 | 49 | 84 |
| | 4 | 31 | 72 | 103 |
| | 5 | 34 | 48 | 82 |
| | 6 | 34 | 52 | 86 |
| | 7 | 35 | 45 | 80 |
| | 8 | 31 | 54 | 85 |
| | 9 | 46 | 47 | 93 |
| | 10 | 54 | 43 | 97 |
| Comparative example | 11 | 29 | 202 | 231 |
| | 12 | 88 | 125 | 213 |
| | 13 | 97 | 191 | 288 |
| | 14 | 49 | 177 | 226 |
| | 15 | 125 | 50 | 175 |

As apparent from Table 4, in cases of the Example rocker arms (Sample Nos. 1 to 10) according to the present invention, not only total abrasion amount of the rocker arm tip and the camshaft is less as compared with the Comparative Example rocker arms (Sample Nos. 11 to 15) but also pitting was not produced on the surfaces of the rocker arm tip in sliding contact and the cam section of the camshaft. This revealed that the rocker arms according to the present invention has very excellent characteristics.

Next, with respect to the rocker arms according to the present invention, investigation was made on the relationship between thickness of the sheet type sintered alloy and hardness of the substrate, more preferable C content in the substrate and brazing condition which are important in case where the rocker arm tip is produced by combining sheet type sintered alloy containing boride and/or multiple boride with the substrate made of steel.

First, a durability test was conducted varying Hertz's contact pressure applied onto the rocker arm tip from 100 kgf/mm$^2$ to 150 kgf/mm$^2$ under the conditions shown in Table 3, in which production status of buckling of the substrate was inspected after the durability test in terms of the varied Rockwell C-scale hardness ($H_RC$) of the rocker arm tip substrate and the varied thickness t (mm) of the sheet type sintered alloy of boride and/or multiple boride. The result of this test is shown in FIG. 1.

As apparent from FIG. 1, in case where the sheet type sintered alloy of boride and/or multiple boride is securely combined through the steel made substrate with the rocker arm main body, it has been found that no buckling was produced in the substrate, no fine cracks and the like were produced in the sheet type sintered alloy, and abrasion amount of the rocker arm tip and the camshaft was less, if the thickness t of the sheet type sintered alloy of boride and/or multiple boride was within a range from 0.2 to 0.8 mm and additionally the Rockwell C-scale hardness number ($H_RC$) of the rocker arm tip substrate was in the relationship given by the equation of $H \geqq 28 - 15t$. In FIG. 1, a symbol indicates the fact that no buckling of the rocker arm tip and no fine cracks of the sheet type sintered alloy occurred. A symbol Δ indicates the fact that the curvature of the rocker arm tip sliding surface was distorted. A symbol X indicates the fact that buckling of the substrate and fine cracks of the sheet type sintered alloy occurred.

Next, rocker arms of Sample Nos. 16 to 19 shown in Table 5 were produced in a similar manner to the above under conditions where composition and density ratio of compact and sintering temperature were the same as of Sample Nos. 5 to 9 in Table 1 while changing C content in the substrate and brazing condition. The thus produced rocker arms were subjected to a wear resistance evaluation test under the same condition as in Table 3 to give results shown in Table 6.

TABLE 6

| Sample No. | Abrasion amount (μm) of rocker arm tip | Abrasion amount (μm) of camshaft | Total abrasion amount (μm) of rocker arm tip and camshaft | Remarks |
|---|---|---|---|---|
| 16 | 375 | 324 | 699 | Buckling partially occured in rocker arm tip substrate |
| 17 | 350 | 306 | 656 | Buckling partially occured in rocker arm tip substrate |
| 18 | — | — | — | No test conducted since curvature of rocker arm tip exceeded drawing tolerance |
| 19 | 92 | 113 | 205 | |

Table 6 depicts the following facts: In the case where the C content of the rocker arm tip substrate is too little as in Sample No. 16, the hardness of the substrate did not reach a necessary level, so that buckling occurred partially in the substrate. In the case where the C content of the substrate was too much as in Sample No. 19, carbon in the substrate removed into the sheet type sintered alloy by diffusion to allow carbide to crystallize out in the joining phase thereby lowering deflective strength and corrosion resistance of the sheet type sintered alloy. In the case where the cooling rate after brazing was too low as in Sample No. 17, a desired hardness of the substrate could not be obtained and therefore buckling occurred partially in the substrate. Additionally in the case where the cooling rate after brazing was too high, the curvature of surface of the rocker arm tip was recognized to be distorted owing to the difference in thermal expansion between the sheet type sintered alloy and the substrate. Thus, all the above-mentioned four cases were confirmed not to be preferable.

Subsequently, durability evaluation test was conducted on the rocker arm having the same detail as in Sample No. 3 in Table 1 under the condition shown in Table 3, varying surface roughness ($R_{max}$) as shown in Table 7 which shows the results of this durability evaluation test.

TABLE 7

| Sample No. | Surface roughness of rocker arm tip ($R_{max}$) | Abrasion amount (μm) of rocker arm tip | Abrasion amount (μm) of camshaft | Total abrasion amount (μm) of rocker arm tip and camshaft |
|---|---|---|---|---|
| 3-1 | 5-6 (μm) | 47 | 221 | 268 |
| 3-2 | 2.5-3.5 μm | 49 | 165 | 214 |
| 3-3* | 1.5-2.0 μm | 35 | 49 | 84 |
| 3-4 | 1.0-1.5 μm | 31 | 30 | 61 |
| 3-5 | 0.5-1.0 μm | 24 | 19 | 43 |
| 3-6 | Not larger than 0.5 μm | 23 | 15 | 38 |

Note:
*represents a sample identical with Sample No. 3 in Table 4.

Table 7 reveals that the abrasion amount of both the rocker arm tip and the camshaft were less in the case where surface roughness of the rocker arm tip was less than 2.0 μm ($R_{max}$), whereas the abrasion amount of the camshaft unavoidably abruptly increased in the case where the surface roughness exceeded 2.0 m ($R_{max}$). Accordingly, it is preferable that the surface roughness of the surface of the rocker arm tip is not larger or rougher than 2.0 μm ($R_{max}$).

Subsequently, in case where the rocker arm is used under a more severe condition than normal such as a condition where actual vehicle cruising is made using engine lubricating oil used during vehicle cruising of not less than 20,000 km without oil change and accordingly containing much soot (not less than 5 wt%), wear of the camshaft in sliding contact with the rocker arm is mainly caused by polishing due to soot and therefore it is preferable that the rocker arm is further limited in B content of the rocker arm tip sintered alloy, the rate of the hard phase, the hardness of the sintered alloy, the maximum grain size of the boride and/or multiple boride, and the surface roughness and the surface phase of the rocker arm tip to which the camshaft sliding contacts, over the abovediscussed embodiments of the present invention. That is to say, particularly from the view points of suppressing the abrasion amount of the camshaft as the opposite member, it is preferable that the sintered alloy has a B content within a range from 3.0 to 4.8% by weight, a rate of the hard phase ranging from 40 to 58% by weight, a maximum grain size of the boride and/or mltiple boride ranging not larger than 10 μm, a Rockwell A-scale hardness number ranging from 80 to 86, a deflective strength ranging not lower than 175 kgf/mm$^2$, and a surface roughness ($R_{max}$) of the slidingly contacting surface ranging not larger or rougher than 1.2 μm.

Additionally, with respect to the shape of the rocker arm tip sintered alloy, the surface (in sliding contact with the camshaft) of the rocker arm tip sintered alloy is preferably formed convex or projects at its central portion. It is to be noted that the convex shape rocker arm tip is difficult to be produced by using a so-called laminated rocker arm tip which is formed by combining a sheet type sintered alloy of boride and/or multiple boride with a substrate made of low-alloy steel because the sintered alloy and the low-alloy steel are largely different in coefficient of thermal expansion. Therefore, the whole body of the rocker arm tip having the convex surface is preferably formed of the sintered alloy of boride and/or double boride as a so-called integral rocker arm tip.

Figure 2:
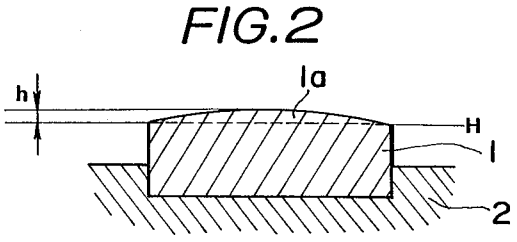
FIG. 2 is a cross-sectional view of a rocker arm tip integrally made up of a sintered alloy containing boride and/or multiple boride, taken in a plane perpendicular to the axis of a camshaft.

With respect to the convex shape of the integral rocker arm tip shown in FIG. 2 which is a cross-section taken in a plane perpendicular to the axis of the camshaft or the axis around which the rocker arm is swingable, the height h of a convex section 1a of a sintered alloy 1 is preferably within a range from 5 to 30 μm. Because, if the height h is less than 5 μm, a slight attacking ability against the camshaft cam is recognized. If the height h exceeds 30 μm, contacting bearing pressure applied to the camshaft cam is raised thereby providing a possibility of producing pitting in the camshaft cam. The height h of the convex section of the sintered alloy is a distance between a horizontal surface or level H and the top surface or level at the central portion of the integral rocker arm tip 1 in FIG. 2. The convex section 1*a* extends parallel with the axis of the camshaft though not shown. The rocker arm tip 1 is securely fitted or embedded in a rocker arm main body 2.

In order to obtain the rocker arm tip having such a dimension of the height h, it is effective to control the heating and cooling condition during brazing of the integral rocker arm tip made of the sintered alloy containing boride and/or multiple boride onto the rocker arm main body. In this case, although heating by a heating furnace is usually used for brazing, high frequency induction heating is preferable for brazing because cooling after brazing can be easily carried out. Additionally, silver brazing metal is preferable as a brazing metal, and the brazing temperature is preferably within a range from 820° to 880° C. The cooling rate after brazing is preferably within a range from 10° to 120° C./min. If the cooling rate is lower than 10° C./min, the height (dimension) h not smaller than 5 μm cannot be obtained. If the cooling rate exceeds 120° C./min, it is too high and therefore a larger warp is produced so that the dimension h unavoidably exceeds 30 μm.

Production of the rocker arm tip suitable for use under the above-mentioned more severe conditions (for example, vehicle cruising is made with a diesel engine provided with the EGR system using used oil containing much soot) will be discussed in detail hereinafter, in which the whole rocker arm tip is formed of a sintered alloy containing boride and/or multiple boride.

In this case, Fe-B prepared by water or gas atomization or Fe-B alloy powder was used as the source of boron for the boride and/or multiple boride of the sintered alloy. According to circumstances, ferroboron powder, powder of boride of each of Mo, W, Ti, Cr and the like, or B simple substance powder may be used as the source of boron. The above-mentioned powder as the B source was blended with metal powder of Mo, W, Ti, V, Fe, Cr, Ni, Co and the like or alloy powder containing two or more of these elements and carbon powder to obtain the detail of the sintered alloy as shown in Tables 8A and 8B. In this case, with respect to the composition of the sintered alloy except for B component, Sample Nos. 20 to 29 and 32 to 39 was Fe-35 wt% Mo-8 wt% Cr-3 wt% Ni-2 wt% W-1 wt% Co-0.5 wt% V-0.2 wt% Ti-0.5 wt% C; Sample Nos. 30 was Fe-27 wt% Cr-12 wt% Mo-2 wt% W-0.5 wt% V-0.1 wt% C; and Sample No. 31 was Fe-20 wt% Cr-20 wt% Ni-12 wt% Mo-0.5 wt% Ti-0.1 wt% C.

The above-mentioned blended powder was wet-pulverized in organic solvent by using a vibration-ball mill or the like, and then dried and granulated. The thus granulated powdered was compacted under a pressure of 1000 to 2000 kgf/cm$^2$ to obtain a rocker arm tip compact having a density ratio of 50 to 60%. Subsequently, the rocker arm tip compact was heated at the sintering temperature to accomplish liquid phase sintering thereby to produce a rocker arm tip material. Here, the liquid phase sintering was preferably accomplished under a condition where temperature was within a range from 1150° to 1350° C., and time was within a range from 15 to 90 minutes. This was because if the sintering temperature was lower than 1150° C., sintering could not sufficiently proceed to produce a sintered alloy having many pores. If the sintering temperature exceeded 1350° C., crystal grain is coarsened thereby lowering deflective strength. Additionally, if the sintering time was less than 15 minutes, sintering of the sintered alloy containing boride and/or multiple boride could not sufficiently proceed. Even if the sintering time exceeded 90 minutes, improvement in strength of the sintered alloy could not be recognized.

Subsequently, the above-mentioned rocker arm tip material was machined to obtain a rocker arm tip having dimentions with which the rocker arm tip material could be combined with the rocker arm main body under brazing. Then, the surface (to be in sliding contact with the camshaft) of the rocker arm tip was finished to obtain the final shape in which the surface to which the camshaft cam slides was formed horizontal in a plane perpendicular to the axis of a camshaft to be contacted. Next, the rocker arm tip was set through a thin piece of silver brazing metal on the rocker arm main body and heated at 820° to 880° C. by high frequency induction heating thereby to accomplish brazing. Immediately after this, cooling was made at cooling rate of 10° to 120° C./min under air-cooling or compulsory air-cooling due to air blowing. Then final finishing of the surface (in sliding contact with the camshaft) of the rocker arm tip was carried out to obtain the rocker arms of Sample Nos. 20 to 29 in Table 8A.

Additionally, the rocker arms of Sample Nos. 30 to 39 in Tables 8A and 8B were obtained in the same production manner as mentioned above, altering detail of the sintered alloy containing boride and/or multiple boride, detail of the rocker arm tip, brazing condition, and the like.

Next, a wear resistance evaluation test upon actual vehicle cruising was conducted on these rocker arms of Sample Nos. 20 to 39 under conditions shown in Table 9.

TABLE 9

| Item | Condition |
|---|---|
| Engine | Diesel engine (displacement: about 2.0 liters) |
| Test mode | I. 1,500 rpm, EGR rate: 30%, ¼Load<br>II. 3,000 rpm, EGR rate: 20%, ¾Load |
| Test time | I. 20 hrs<br>II. 10 hrs } 3 cycles |
| Cam material | Cast iron (surface chilled) |
| Vavle spring force | 27 kgf (in installed state of valve spring) |
| Fuel | Diesel fuel according to EPA (S: 0.2 wt % contained) |
| Lubricating oil | 10W-30/CC for diesel engine (used for 30,000 km cruising) |
| Oil temperature | varied 85 to 100° C. depending on engine operation |

Figure 3:
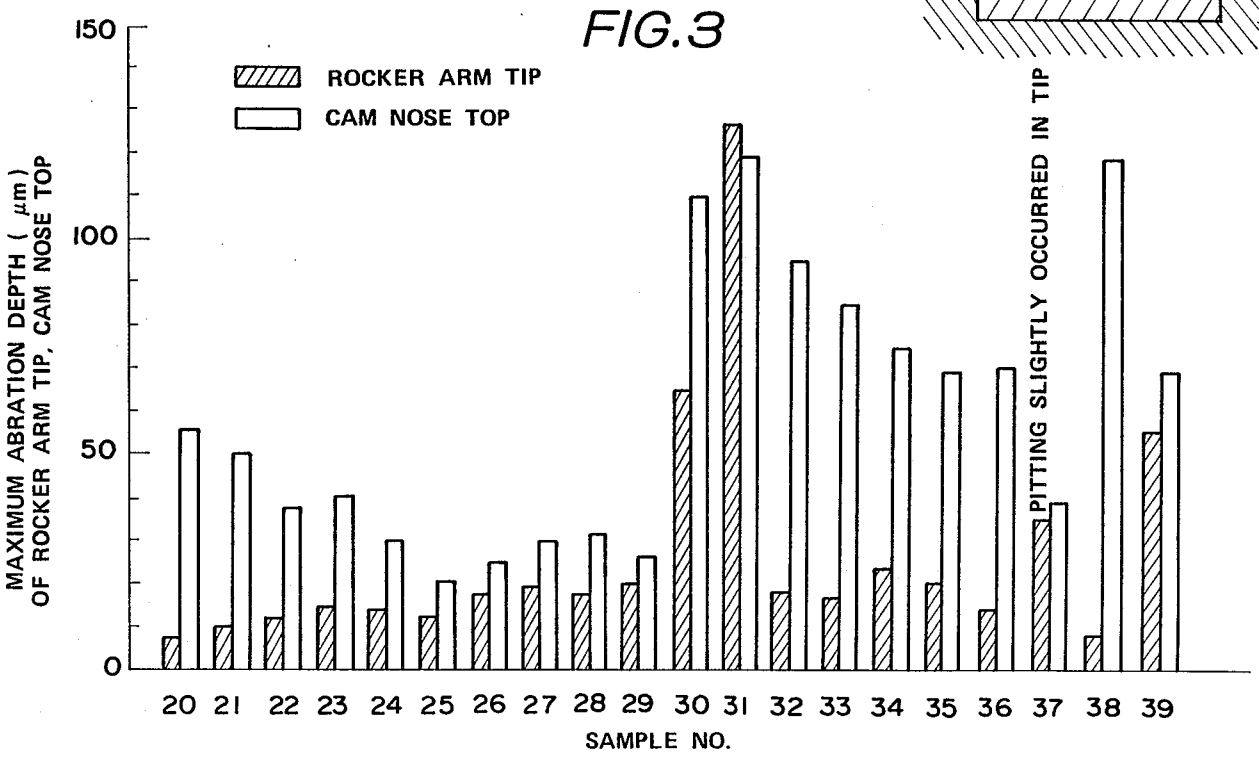
FIG. 3 is a graph showing abrasion amounts of rocker arm tips produced according to Tables 8A and 8B and camshaft after a wear resistance evaluation test.

The measured result or data of the wear resistance evaluation test is shown in FIG. 3.

As appreciated from the above, the rocker arm of Sample Nos. 20 to 29 are within a specially limited range in which the rocker arm tip was made up of the sintered alloy including the hard phase of boride and/or multiple boride of at least one (including Fe) of Fe, Mo, W, Cr, Ti, V, Co and the like, the hard phase being homogeneously dispersed in the joining phase of martensite stainless steel, the sintered alloy containing boron ranging from 3.0 to 4.8% by weight, the hard phase ranging from 40 to 58% by weight, and having a maximum grain size of the boride and/or multiple boride ranging not larger than 10 m, a Rockwell A-scale hardness number ($H_RA$) ranging from 80 to 86, deflective strength ranging not smaller than 175 kgf/mm$^2$, and a surface roughness ($R_{Max}$) of the surface in sliding contact with the camshaft ranging not larger or rougher than 1.2 μm, the rocker arm tip having a shape wherein the profile of the slidingly contacting surface thereof in the cross-section in the plane perpendicular to the axis of the camshaft is as shown in FIG. 2 so that the top surface of the rocker arm tip is gently-sloping to have the height h of the convex section within a range from 5 to 30 μm.

In this regard, it has been confirmed that the rocker arms of Sample Nos. 20 to 29 falling within the above-mentioned specially limited range are not only less in abrasion amount of the rocker arm tip but also lower in attacking ability against and excellent in concordance with the camshaft cam as the opposite member than the rocker arms of Sample Nos. 30 to 39, which are out of the above-mentioned specially limited range, under the severe wear resistance evaluation test condition. Additionally, it has been also confirmed that the rocker arm of Sample No. 25 subjected to a treatment for forming zinc phosphate coating for lubrication and the rocker arm of Sample No. 29 subjected to the salt bath soft-nitriding treatment are improved in concordance with the camshaft cam as the opposite member.

As has been described hereinbefore, the rocker arm of the automotive vehicle engine is formed with the section in sliding contact which is formed of the sintered alloy in which the hard phase made up of boride and/or multiple boride of at least one, including iron, of elements capable of forming the boride and/or multiple boride is homogeneously dispersed in the joining phase of martensite stainless steel. The sintered alloy is formed into the integral rocker arm tip to be united to the rocker arm main body, or formed into sheet type and united to the rocker arm main body together with the substrate. In either case, excellent wear resistance characteristics can be obtained in which abrasion amount both in the rocker arm tip and the camshaft is remarkably little. This depends on the fact that the present invention has been accomplished on the basis of the above-discussed knowledge that abrasion amount increase in a rocker arm tip and a camshaft in a diesel engine provided with an EGR system is mainly caused by the synergestic effect of removal of a wear resistance protective film of an oil additive which removal is due to soot in engine lubricating oil and corrosion of the newly exposed metal surface in the rocker arm tip which corrosion is due to $SO_x$ gas in exhaust gas. In this regard, against the wear resistance protective film removal due to soot, the hard phase of the sintered alloy is made up of boride and/or multiple boride excellent in concordance with metal as compared with conventional carbides, thereby reducing wear caused by metal-to-metal contact. Against corrosion of the newly exposed metal surface due to $SO_x$ in exhaust gas, the joining phase is made up of martensite stainless steel excellent in corrosion resistance thereby to reduce corrosion wear. Thus, it has been effectively achieved to suppress the abrasion amount of not only the rocker arm tip but also the cam section as the opposite member to a considerable low level, thereby providing the rocker arm (engine component part) having excellent characteristics which has been never found in the conventional rocker arms.

For reference, a wear resistance evaluation test was made on the rocker arm having the detail of Sample No. 3 in Table 1 and on a variety of conventional rocker arms for the purpose of characteristics comparison under the test conditions shown in Table 3. The result of this test is shown in Table 10.

Additionally, another wear resistance evaluation test was made on the rocker arm having the detail of Sample No. 25 in Table 8A and on the conventional rocker arms under the test conditions shown in Table 9. The result of this test is shown in Table 11.

TABLE 10

| Material of section of rocker arm tip in sliding contact | Total abrasion amount of rocker arm tip and camshaft (μm) |
|---|---|
| Sample No. 3 of present invention | 84 |
| Chilled casting | 1520 |
| Super hard alloy (WC-9 wt % Co) | 205 |
| High Cr cast iron (14 wt % Cr) subjected to tufftride treatment | 322 |
| High Cr iron sintered alloy (18 wt % Cr) subjected to tufftride treatment | 315 |

TABLE 11

| Material of rocker arm tip | Maximum abrasion depth of rocker arm (μm) | Maximum abrasion depth of cam nose (μm) |
|---|---|---|
| Sample No. 25 of present invention | 12 | 20 |
| Chilled casting | 302 | 80 |
| Super hard alloy (WC-9 wt % Co) | 5 | 155 |
| High Cr cast iron (14 wt % Cr) subjected to tufftride treatment | 23 | 292 |
| High Cr iron sintered alloy (18 wt % Cr) subjected to tufftride treatment | 37 | 133 |

As apparent from Tables 10 and 11, with the rocker arms according to the present invention, the total abrasion amount of the rocker arm tip and the camshaft is remarkably little as compared with in case of the conventional rocker arms.

While the discussion of the present invention has been made mainly on rocker arms suitable for diesel engines equipped with an EGR system, it will be understood the principle of the present invention is applicable to other rocker arms in other engines, to other components of valve operating mechanism such as valve lifters and valve lash adjustors, and to a variety of other automotive vehicle component in sliding contact under severe conditions.

TABLE 1

| Divison | Sample No. | Composition Fe* | B | Mo | W | Cr | Ni | V | Co | Ti | Nb + Ta | C | Others | Density ratio (%) of compact | Sintering temp. (°C.) |
|---|---|---|---|---|---|---|---|---|---|---|---|---|---|---|---|
| Example | 1 | Bal. | 5.0 | 50 | — | 7.0 | 2.0 | — | — | — | — | 0.4 | — | 48 | 1250 |
| | 2 | " | 4.5 | 40 | 10 | 6.0 | 1.5 | — | — | 0.5 | 0.5 | 0.2 | — | 50 | 1220 |
| | 3 | " | 4.0 | 35.5 | — | 6.5 | " | 2.0 | — | " | — | 0.15 | — | 47 | 1225 |
| | 4 | " | " | 30 | 8 | 6.5 | " | — | 4.0 | — | — | 0.14 | Cu:2.0 | 46 | 1240 |
| | 5 | " | " | 37 | — | 6.0 | " | 2.0 | — | — | — | 0.15 | — | 47 | 1220 |
| | 6 | " | " | " | — | " | " | " | " | — | — | " | — | " | " |
| | 7 | " | " | " | — | " | " | " | — | — | — | " | — | " | " |
| | 8 | " | " | " | — | " | " | " | — | — | — | " | — | " | " |
| | 9 | " | " | " | — | " | " | " | — | — | — | " | — | " | " |
| | 10 | " | 3.0 | 10 | 30 | 5.0 | 1.0 | — | — | — | 4.0 | 0.10 | — | 50 | 1280 |
| Comparative example | 11 | " | 4.5 | 40 | 10 | 6.0 | 1.5 | — | — | 0.5 | 0.5 | 0.2 | — | 45 | 1240 |
| | 12 | " | 3.7 | 35 | — | 10.0 | — | 1.0 | — | — | — | 0.01 | — | 49 | 1275 |
| | 13 | " | 4.2 | 40 | — | 6.0 | 15.0 | 1.0 | — | — | — | " | — | " | 1260 |
| | 14 | " | 6.0 | 55 | 8 | | 1.5 | 4.2 | — | 2.0 | — | 0.12 | — | 45 | 1235 |
| | 15 | " | 2.0 | 16 | — | 5.0 | 1.0 | 2.0 | 2.0 | — | — | 0.11 | — | 50 | 1210 |

Remarks:
*represents the fact that balance includes unavoidable impurities.

TABLE 2

| Division | Sample No. | Detail of sheet type sintered alloy containing boride and/or multiple boride: B Content (wt %) | Rate of hard phase (wt %) | Max. particle size of boride and/or multiple boride (μm) | Joining phase | Hardness ($H_RA$) | Deflective strength (kgf/mm²) |
|---|---|---|---|---|---|---|---|
| Example | 1 | 5.0 | 62 | Not larger than 15 | Martensite stainless steel | 88.7 | 228 |
| | 2 | 4.5 | 56 | " | " | 87.2 | 241 |
| | 3 | 4.0 | 50 | " | " | 85.3 | 252 |
| | 4 | " | " | 15–45 | " | 86.0 | 180 |
| | 5 | " | " | Not larger than 15 | " | 86.7 | 230 |
| | 6 | " | " | " | " | 85.3 | 252 |
| | 7 | " | " | " | " | " | " |
| | 8 | " | " | " | " | " | " |
| | 9 | " | " | " | " | " | " |
| | 10 | 3.0 | 40 | " | " | 83.2 | 265 |
| Comparative example | 11 | 4.5 | 55 | 40–70 | " | 85.7 | 151 |
| | 12 | 3.7 | 52 | Not larger than 15 | Ferrite stainless steel | 83.5 | 180 |
| | 13 | 4.2 | 54 | " | Austenite stainless steel | 84.0 | 185 |
| | 14 | 6.0 | 74 | " | Martensite steel | 91.0 | 165 |
| | 15 | 2.0 | 28 | " | " | 75.4 | 170 |

| Division | Sample No. | Detail of rocker tip: Thickness of sheet type sintered alloy (mm) | Hardness of substrate ($H_RC$) | Material of substrate | Normal-lizing treatment | Brazing Condition: Brazing temp. (°C.) | Cooling rate (°C./min) | Remarks |
|---|---|---|---|---|---|---|---|---|
| Example | 1 | 0.5 | 30 | SCM435 | done | 850 | 80 | |
| | 2 | " | " | " | " | " | " | |
| | 3 | " | " | " | " | " | " | |
| | 4 | " | " | " | " | " | " | |
| | 5 | 0.3 | 35 | SCr445 | " | " | " | |
| | 6 | 0.5 | 28 | SCM435 | " | 830 | 50 | |
| | 7 | " | 33 | " | " | 870 | 100 | |
| | 8 | 0.7 | 36 | SNCM447 | " | " | " | |
| | 9 | " | 25 | SNCM431 | " | 850 | 80 | |
| | 10 | 0.5 | 30 | SCM435 | " | " | " | |
| Comparative example | 11 | " | " | " | " | " | " | Boride and/or double boride of Sample No. 2 (large grain size) |
| | 12 | " | " | " | " | " | " | Joining phase: ferrite stainless steel |
| | 13 | " | " | " | " | " | " | Joining phase: austenite stainless steel |
| | 14 | 0.5 | 30 | SCM435 | " | " | " | B added amount: exceeding 5.0 wt % |
| | 15 | " | " | " | " | " | " | B added amount: less than 3.0 wt % |

TABLE 5

| Sample No. | Detail of sheet type sintered alloy containing boride and/or multiple boride: B Content (wt %) | Rate of hard phase (wt %) | Max. particle size of boride and/or multiple boride (μm) | Joining phase | Hardness ($H_RA$) | Deflective strength (kgf/mm²) |
|---|---|---|---|---|---|---|
| 16 | 4.0 | 50 | Not larger than 15 | Martensite stainless steel | 85.3 | 252 |
| 17 | " | " | " | " | " | " |
| 18 | " | " | " | " | " | " |

TABLE 5-continued

| | | | | | | | |
|---|---|---|---|---|---|---|---|
| 19 | " | " | " | | " | 87.8 | 157 |

| Sample No. | Details of rocker tip: Thickness of sheet type sintered alloy (mm) | Hardness of substrate ($H_RC$) | Material of substrate | Normalizing treatment | Brazing Condition: Brazing temp. (°C.) | Cooling rate (°C./min) | Remarks |
|---|---|---|---|---|---|---|---|
| 16 | 0.5 | 17 | SCM415 | done | 830 | 50 | C content of substrate: less than 0.25 wt % |
| 17 | " | 18 | SCM435 | " | 830 | 20 | Cooling rate after brazing: lower than 40° C./min |
| 18 | " | 34 | SCM435 | " | 850 | 150 | Cooling rate after brazing: exceeding 120° C./min |
| 19 | 0.3 | 40 | SKS5 | " | " | 80 | C content of substrate: exceeding 0.5 wt % |

TABLE 8

| Sample No. | Detail of sheet type sintered alloy of containing boride and/or multiple boride: B Content (wt %) | Rate of hard phase (wt %) | Max. particle size of boride and/or multiple boride (μm) | Joining phase | Hardness ($H_RA$) | Deflective strength (kgf/mm$^2$) |
|---|---|---|---|---|---|---|
| 20 | 4.8 | 58 | Not larger than 5 | Martensite stainless steel | 85.7 | 235 |
| 21 | 4.5 | 56 | " | " | 84.6 | 246 |
| 22 | 4.0 | 50 | " | " | 83.5 | 257 |
| 23 | " | " | 5-10 | " | 84.0 | 193 |
| 24 | " | " | Not larger than 5 | " | 83.5 | 257 |
| 25 | " | " | " | " | " | " |
| 26 | 3.0 | 40 | " | " | 81.2 | 268 |
| 27 | " | " | " | " | " | " |
| 28 | " | " | " | " | " | " |
| 29 | " | " | " | " | " | " |
| 30 | 3.7 | 52 | " | Ferrite stainless steel | 80.5 | 198 |
| 31 | 4.0 | 45 | " | Austenite stainless steel | 80.7 | 195 |
| 32 | 4.0 | 50 | Not larger than 5 | Martensite stainless steel | 83.5 | 257 |
| 33 | " | " | " | " | " | " |
| 34 | " | " | " | " | " | " |
| 35 | " | " | " | " | " | " |
| 36 | " | " | " | " | " | " |
| 37 | " | " | " | " | 80.8 | 161 |
| 38 | 5.0 | 62 | " | " | 88.7 | 228 |
| 39 | 2.0 | 28 | " | " | 75.4 | 144 |

| Sample No. | Surface roughness of rocker arm tip R max (μm) | Detail of rocker arm tip | Brazing Condition: Brazing temp. (°C.) | Cooling rate (°C./min) | Shape of Cross-section: Shape of warp | Warp of central portion: Convex(+), Concave(−) h (μm) | Remarks |
|---|---|---|---|---|---|---|---|
| 20 | not larger than 1.0 | Integral tip | 850 | 80 | Convex | +22 | |
| 21 | " | " | " | " | " | +22 | |
| 22 | " | " | " | " | " | +22 | |
| 23 | " | " | " | 50 | " | +18 | |
| 24 | " | " | " | 30 | " | +10 | |
| 25 | " | " | " | " | " | +10 | Zn—phosphate coating |
| 26 | " | " | 870 | 20 | " | +5 | |
| 27 | " | " | " | 120 | " | +30 | |
| 28 | " | " | " | 50 | " | +15 | |
| 29 | " | " | " | " | " | +15 | Salt bath soft-nitriding treatment |
| 30 | " | " | " | 30 | " | +7 | Joining phase: ferrite stainless steel |
| 31 | " | " | " | " | " | +8 | Joining phase: austenite stainless steel |
| 32 | Not larger than 1.0 | Laminated tip | 870 | 80 | Concave | −10 | Laminated tip |
| | | Sintered alloy layer / Substrate SCM435 | | | | | |
| 33 | " | Laminated tip | " | " | Flat | 0 | Tip whose warp (concave) was |

TABLE 8-continued

| | | | | | | | |
|---|---|---|---|---|---|---|---|
| | | Sintered alloy layer / Substrate SCM435 | | | | | corrected by grinding |
| 34 | " | Integral tip | " | 150 | Convex | +40 | Cooling rate after brazing: exceeding 120° C./min. |
| 35 | " | " | " | 5 | " | +2 | Cooling rate after brazing: less than 10° C./min. |
| 36 | 1.4 | " | " | 30 | " | +10 | Surface roughness of tip: exceeding 1.2 μm ($R_{max}$) |
| 37 | Not larger than 1.0 | " | " | 40 | " | +13 | Deflective strength: less than 175 kg/mm$^2$ (lowered density due to lowered sintering temp.) |
| 38 | " | " | " | 30 | " | +12 | B added amount: exceeding 5.0 wt % |
| 39 | " | " | " | " | " | +9 | B added amount: less than 3.0 wt % |

What is claimed is:

1. A component part of a vehicle, comprising a section having a surface slidingly contacting with an opposite member, said section being formed of a sintered alloy including a joining phase of martensite stainless steel, and a hard phase of at least one of boride and multiple boride of at least one, including iron (Fe), of elements capable of forming said at least one of boride and multiple boride, said hard phase being homogeneously dispersed in said joining phase, said sintered alloy containing boron ranging from 3.0 to 5.0% by weight and said hard phase ranging from 40 to 62% by weight, said sintered alloy having a maximum grain size of said at least one of boride and multiple boride ranging not larger than 50 μm, a Rockwell A-scale hardness number ranging not less than 80, and a deflective strength ranging not lower than 175 kgf/mm$^2$.

2. A component part as claimed in claim 1, wherein said component part is of an internal combustion engine.

3. A component part as claimed in claim 2, wherein said component part is of a valve operating mechanism.

4. A component part as claimed in claim 2, wherein said component part is a rocker arm.

5. A component part as claimed in claim 2, wherein said elements capable of forming said at least one of boride and multiple boride includes iron(Fe), tungsten (W), chromium (Cr), titanium (Ti), vanadium (V), niobium (Nb), tantalum (Ta), hafnium (Hf), zirconium (Zr), and cobalt (Co).

6. A component part as claimed in claim 2, wherein said sintered alloy has a Rockwell A-scale hardness number ranging not larger than 90.

7. A component part of an internal combustion engine, comprising a section having a surface slidingly contacting with an opposite member, said section being formed of a sintered alloy including a joining phase of martensite stainless steel, and a hard phase of at least one, including iron (Fe), selected from the group consisting of iron (Fe), tungusten (W), chromium (Cr), titanium (Ti), vanadium (V), niobium (Nb), tantalum (Ta), hafnium (Hf), zirconium (Zr), and cobalt (Co), said hard phase being homogeneously dispersed in said joining phase, said sintered alloy containing boron (B) ranging from 3.0 to 5.0 by weight and said hard phase ranging from 40 to 62% by weight, said sintered alloy having a maximum grain size of said at least one of boride and multiple boride ranging not larger than 50 μm, a Rockwell A-scale hardness number ranging not less than 80, and a deflective strength ranging not less than 175 kgf/mm$^2$.

8. A component part as claimed in claim 7, wherein said component part comprises a main body, and a tip member secured to said main body, said tip member including a substrate, and said sintered alloy of a sheet type, said sheet type sintered alloy being secured to said substrate and having said surface.

9. A component part as claimed in claim 8, wherein said sheet type sintered alloy has a thickness ranging from 0.2 to 0.8 mm.

10. A component part as claimed in claim 8, wherein said surface of said sheet type sintered alloy has a surface roughness ($R_{max}$) ranging not larger than 2.0 m.

11. A component part as claimed in claim 8, wherein said substrate is made of a steel having a carbon content ranging from 0.25 to 0.5% by weight.

12. A component part as claimed in claim 8, wherein hardness of said substrate and thickness of said sheet type sintered alloy are in a relationship represented by an equation of:

$$H \leqq 18 - 15t$$

where H is the Rockwell C-scale hardness number of said substrate; and t is the thickness (mm) of said sheet type sintered alloy.

13. A component part as claimed in claim 8, wherein said component part comprises silver brazing metal through which said tip member is secured to said main body.

14. A component part as claimed in claim 7, wherein said component part comprises a main body and a tip member secured to said main body, said tip member being formed of said sintered alloy and having said surface.

15. A component part as claimed in claim 14, wherein said sintered alloy contains said boron ranging from 3.0 to 4.8% by weight.

16. A component part as claimed in claim 14, wherein said sintered alloy contains said hard phase ranging from 40 to 58% by weight.

17. A component part as claimed in claim 14, wherein said sintered alloy has a maximum grain size of said at least one of boride and multiple boride ranging not larger than 10 μm.

18. A component part as claimed in claim 14, wherein said sintered alloy has a Rockwell A-scale hardness number ranging from 80 to 86.

19. A component part as claimed in claim 14, wherein said surface has a surface roughness ($R_{max}$) not larger than 1.2 m.

20. A component part as claimed in claim 14, wherein said tip member is formed with a convex section contactable with said opposite member and having a height ranging from 5 to 30 μm.

21. A rocker arm of a valve operating mechanism of an internal combustion engine, said rocker arm comprising a main body and a tip member secured to said main body, said tip member includes a substrate and a sheet type sintered alloy secured to said substrate and having a surface slidingly contacting with a camshaft, said sintered alloy including a joining phase of martensite stainless steel, and a hard phase of at least one, including iron (Fe), selected from the group consisting of iron (Fe), tungusten (W), chromium (Cr), titanium (Ti), vanadium (V), niobium (Nb), tantalum (Ta), hafnium (Hf), zirconium (Zr), and cobalt (Co), said hard phase being homogeneously dispersed in said joining phase, said sintered alloy containing boron (B) ranging from 3.0 to 5.0 by weight and said hard phase ranging from 40 to 62% by weight, said sintered alloy having a thickness ranging from 0.2 to 0.8 mm, a maximum grain size of said at least one of boride and multiple boride ranging not larger than 50 m, a Rockwell A-scale hardness number ranging not less than 80, and a deflective strength ranging not less than 175 kgf/mm$^2$, said surface having a surface roughness ($R_{max}$) ranging not larger than 2.0 μm, said substrate being made of steel having a carbon (C) content ranging from 0.25 to 0.5% by weight, hardness of said substrate and the thickness of said sintered alloy being in a relationship represented by an equation of:

$$H \geqq 28 - 15t$$

where H is the Rockwell C-scale headness number of said substrate, and t is the thickness (mm) of said sintered alloy.

22. A rocker arm of a valve operating mechanism of an internal combustion engine, said rocker arm comprising a main body and a tip member secured to said main body, said tip member being formed of a sintered alloy and having a surface slidingly contactable with a camshaft, said sintered alloy including a joining phase of martensite stainless steel, and a hard phase of at least one, including iron (Fe), selected from the group consisting of iron (Fe), tungusten (W), chromium (Cr), titanium (Ti), vanadium (V), niobium (Nb), tantalum (Ta), hafnium (Hf), zirconium (Zr), and cobalt (Co), said hard phase being homogeneously dispersed in said joining phase, said sintered alloy containing boron (B) ranging from 3.0 to 4.8 by weight and said hard phase ranging from 40 to 58% by weight, said sintered alloy having a maximum grain size of said at least one of boride and multiple boride ranging not larger than 10 μm, a Rockwell A-scale hardness number ranging from 80 to 86, and a deflective strength ranging not less than 175 kgf/mm$^2$, said surface having a surface roughness ($R_{max}$) ranging not larger than 1.2 μm, said tip member being formed with a convex section contactable with said camshaft, said convex section having a height (h) ranging from 5 to 30 μm.

* * * * *